US007677673B2

(12) United States Patent
Tranquilla et al.

(10) Patent No.: US 7,677,673 B2
(45) Date of Patent: Mar. 16, 2010

(54) STIMULATION AND RECOVERY OF HEAVY HYDROCARBON FLUIDS

(75) Inventors: James Tranquilla, Lower Queensbury (CA); Allan Provost, Lakewood, CO (US)

(73) Assignee: HW Advanced Technologies, Inc., Lakewood, CO (US)

( * ) Notice: Subject to any disclaimer, the term of this patent is extended or adjusted under 35 U.S.C. 154(b) by 187 days.

(21) Appl. No.: 11/682,171

(22) Filed: Mar. 5, 2007

(65) Prior Publication Data

US 2008/0073079 A1 Mar. 27, 2008

Related U.S. Application Data

(60) Provisional application No. 60/827,012, filed on Sep. 26, 2006, provisional application No. 60/867,537, filed on Nov. 28, 2006.

(51) Int. Cl.
*E21B 43/00* (2006.01)

(52) U.S. Cl. ..... 299/2; 166/248; 166/249

(58) Field of Classification Search ..... 299/2; 166/248, 249, 65.1

See application file for complete search history.

(56) References Cited

U.S. PATENT DOCUMENTS

| | | | | |
|---|---|---|---|---|
| 849,524 | A * | 4/1907 | Baker | 299/4 |
| 1,520,737 | A | 12/1924 | Wright | |
| 1,660,187 | A | 2/1928 | Adolf | |
| 1,722,679 | A | 7/1929 | Leo | |
| 1,735,012 | A | 11/1929 | Lyon | |
| 1,735,481 | A | 11/1929 | Uren | |
| 1,811,560 | A | 6/1931 | Leo | |
| 1,816,260 | A | 7/1931 | Edward | |
| 1,852,717 | A | 4/1932 | Grinnell et al. | |
| 1,884,859 | A | 10/1932 | Leo | |
| 1,910,762 | A | 5/1933 | Henry et al. | |
| 2,148,327 | A | 2/1939 | Roger et al. | |
| 2,193,219 | A | 3/1940 | Higgins et al. | |
| 2,200,665 | A | 5/1940 | Bolton | |
| 2,210,582 | A | 8/1940 | Karl et al. | |
| 2,365,591 | A | 12/1944 | Leo | |
| 2,670,801 | A | 3/1954 | Sherborne | |
| 2,783,986 | A | 3/1957 | Nelson et al. | |
| 2,786,660 | A | 3/1957 | Alleman | |
| 2,799,641 | A | 9/1957 | Gordon | |
| 2,857,002 | A | 10/1958 | Pevere et al. | |
| 2,888,987 | A | 6/1959 | Parker | |
| 2,914,124 | A | 11/1959 | Ripley, Jr. | |
| 2,989,294 | A | 6/1961 | Coker | |

(Continued)

FOREIGN PATENT DOCUMENTS

WO WO 2004/004863 A1 1/2004

(Continued)

OTHER PUBLICATIONS

International Search Report for International (PCT) Patent Application No. PCT/US07/79061, mailed Jul. 22, 2008.

(Continued)

*Primary Examiner*—John Kreck
(74) *Attorney, Agent, or Firm*—Sheridan Ross P.C.

(57) ABSTRACT

The present invention is directed to the use of electromagnetic radiation, acoustic energy, and surfactant injection to recover hydrocarbon-containing materials from a hydrocarbon-bearing formation.

26 Claims, 7 Drawing Sheets

U.S. PATENT DOCUMENTS 3,017,168 A 1/1962 Carr
3,024,013 A 3/1962 Heino et al.
3,207,221 A 9/1965 Cochran et al.
3,227,229 A 1/1966 Wakefield, Jr.
3,259,186 A 7/1966 Dietz
3,285,335 A 11/1966 Reistle, Jr.
3,333,637 A 8/1967 Michael
3,338,306 A 8/1967 Cook
3,353,602 A 11/1967 Jan
3,378,075 A 4/1968 Bodine
3,386,508 A 6/1968 Rawl et al.
3,455,392 A 7/1969 Prats
3,456,730 A 7/1969 Lange
3,474,863 A 10/1969 Deans et al.
3,507,330 A 4/1970 Gill
3,530,939 A 9/1970 Turner et al.
3,613,806 A 10/1971 Malott
3,768,559 A 10/1973 Allen et al.
3,838,738 A 10/1974 Redford et al.
3,874,450 A 4/1975 Kern et al.
3,882,941 A 5/1975 Pelofsky et al.
3,884,261 A 5/1975 Clynch et al.
3,948,323 A 4/1976 Sperry et al.
3,954,140 A 5/1976 Hendrick
3,986,557 A 10/1976 Striegler et al.
4,046,191 A 9/1977 Neath
4,084,638 A 4/1978 Whiting
4,085,803 A 4/1978 Butler
4,099,570 A 7/1978 Vandergrift
4,099,783 A 7/1978 Verty et al.
4,106,562 A 8/1978 Barnes et al.
4,140,180 A 2/1979 Bridges et al.
4,144,935 A 3/1979 Bridges et al.
4,160,481 A 7/1979 Turk et al.
4,165,903 A 8/1979 Cobbs
4,193,448 A 3/1980 Jeambey
4,224,988 A 9/1980 Gibson et al.
4,249,777 A 2/1981 Morrell et al.
4,257,650 A 3/1981 Allen
4,285,548 A 8/1981 Erickson
4,301,865 A 11/1981 Kasevich et al.
4,345,650 A 8/1982 Wesley
4,419,214 A 12/1983 Balint et al.
4,434,849 A 3/1984 Allen
4,437,518 A 3/1984 Williams
4,458,945 A 7/1984 Ayler et al.
4,466,484 A 8/1984 Kermabon
4,485,868 A 12/1984 Sresty et al.
4,533,182 A 8/1985 Richards
4,595,239 A 6/1986 Ayler et al.
4,601,607 A 7/1986 Lehmann
4,607,888 A 8/1986 Trent et al.
4,620,593 A 11/1986 Haagensen
4,790,375 A 12/1988 Bridges et al.
4,793,736 A 12/1988 Thompson et al.
4,912,971 A 4/1990 Jeambey
5,082,054 A * 1/1992 Kiamanesh ..... 299/2
5,109,927 A 5/1992 Supernaw et al.
5,293,936 A 3/1994 Bridges
5,339,898 A 8/1994 Yu et al.
5,621,844 A 4/1997 Bridges
5,713,415 A 2/1998 Bridges
6,079,508 A 6/2000 Caza
6,186,228 B1 2/2001 Wegener et al.
6,189,611 B1 2/2001 Kasevich
6,227,293 B1 5/2001 Huffman et al.
6,230,799 B1 5/2001 Slaughter et al.
6,279,653 B1 8/2001 Wegener et al.
6,387,278 B1 5/2002 Leif et al.
6,405,796 B1 6/2002 Meyer et al.
6,427,774 B2 * 8/2002 Thomas et al. ..... 166/248
6,451,174 B1 9/2002 Burkitbaev
6,499,536 B1 12/2002 Ellingsen
6,569,235 B2 5/2003 Carter, Jr.
6,631,761 B2 10/2003 Yuan et al.
6,679,326 B2 1/2004 Zakiewicz
6,758,289 B2 7/2004 Kelley et al.
6,796,381 B2 9/2004 Ayler et al.
6,880,633 B2 4/2005 Wellington et al.
6,923,273 B2 8/2005 Terry et al.
6,929,330 B2 8/2005 Drake et al.
7,059,413 B2 6/2006 Abramov et al.
7,081,196 B2 7/2006 Cullen
7,121,342 B2 10/2006 Vinegar et al.
7,156,176 B2 1/2007 Vinegar et al.
2004/0016377 A1 1/2004 Johnson et al.
2004/0074812 A1 4/2004 Cullen

FOREIGN PATENT DOCUMENTS

WO WO 2004/033377 A1 4/2004
WO WO 2006/128165 A2 11/2006

OTHER PUBLICATIONS

Written Opinion for International (PCT) Patent Application No. PCT/US07/79061, mailed Jul. 22, 2008.
Background of the Invention for the above captioned application (previously provided).
"Testing SAGD: Alberta Research Council Assesses The Technology's Feasibility In Russia", Oilsands Review, Aug. 2006 (3 pages).
Kieways, The Magazine of Peter Kiewit Sons', Inc., Jan.-Feb.-Mar. 2006 (34 pages) (submitted in 2 parts).
Gerry Stephenson et al., "Mining Aspects Of Hard To Access Oil Sands Deposits", Norwest Corporation, Mar. 2, 2006 (57 pages).
C.V. Deutsch et al., "Guide To SAGD Reservoir Characterization Using Geostatistics", Centre for Computational Geostatistics (CCG) Guidebook Series vol. 3, 2005 (27 pages).
"Technical Overview: Nigeria's Bitumen Belt And Developmental Potential", Ministry of Solid Minerals Development, Mar. 6, 2006 (48 pages).
A.C.T. AARTS et al., "Enhancement Of Liquid Flow Through A Porous Medium By Ultrasonic Radiation", SPE Journal 4 (4), Dec. 1999, pp. 321-327.
Bjorndalen et al, "The Effect Of Microwave And Ultrasonic Irradiation On Crude Oil During Production With A Horizontal Well", J Petroleum Science & Eng, vol. 43, 2004, 139-150.
Chakma et al, "The Effects Of Ultrasonic Treatment On The Viscosity Of Athabasca Bitumen And Bitumen-Solvent Mixtures", J Canadian Petroleum Technology, 32 (5) May 1993, 48-51.
Gunal et al., "Alteration Of Asphaltic Crude Rheology With Electromagnetic And Ultrasonic Irradiation", Journal of Petroleum Science and Engineering, vol. 26 (2000) pp. 263-272.
T. Hamida et al., "SPE 92124: Effect Of Ultrasonic Waves On The Capillary-Imbibition Recovery Of Oil", Society of Petroleum Engineers Inc., Apr. 5-7, 2005 (12 pages).
T Hamida et al, "SPE 95327: Effects Of Ultrasonic Waves On Immiscible And Miscible Displacement In Porous Media", Society of Petroleum Engineers, Oct. 9-12, 2005 (18 pages).
K.M. Sadegui et al., "Treatment Of Tar Sand By Cavitation Induced Sonication", Anales de Quimica, vol. 86 (1990) pp. 175-181.
P.K. Seifert et al., "Effect On Ultrasonic Signals Of Viscous Pore Fluids In Unconsolidated Sand", J. Acoust. Soc. Am. 106 (6), Dec. 1999, pp. 3089-3094.
S.A. Shedid, "An Ultrasonic Irradiation Technique For Treatment Of Asphaltene Deposition", Journal of Petroleum Science and Engineering, vol. 42 (2004) pp. 57-70.
SW Wong et al, "High-Power/High-Frequency Acoustic Stimulation: A Novel And Effective Wellbore Stimulation Technology", SPE Production & Facilities, Nov. 2004, pp. 183-188.
S.V. Bauks, "Ultrasonics And Heavy Oil: Research Report", Oct. 4, 2006 (61 pages).

Warren et al., "Microwave Heating of Horizontal Wells in Heavy Oil with Active Water Drive" SPE International, SPE 37114, International Conference on Horizontal Well Technology, Calgary, Canada, Nov. 18-20, 1996, 7 pages.
Background of the Invention for the above-captioned application.
International Preliminary Report on Patentability for International (PCT) Patent Application No. PCT/US07/79061,issued Mar. 31, 2009.
Search Results: microwave and "heavy oil" in 1976; printed Nov. 15, 2005, 5 pages.
Bauks "Ultrasonics & Heavy Oil" Research Report, dated Oct. 4, 2006, pp. 1-61.

* cited by examiner

STIMULATION AND RECOVERY OF HEAVY HYDROCARBON FLUIDS

CROSS REFERENCE TO RELATED APPLICATION

The present application claims the benefits of U.S. Provisional Application Ser. No. 60/827,012, filed Sep. 26, 2006, entitled "Means for the Stimulation and Recovery of Heavy Hydrocarbon Fluids", and 60/867,537, filed Nov. 28, 2006, of the same title, each of which are incorporated herein by this reference.

FIELD OF THE INVENTION

The invention relates generally to recovery of hydrocarbon fluids and particularly to the in situ thermal stimulation and recovery of hydrocarbon fluids.

BACKGROUND OF THE INVENTION

Heavy and extra heavy oil and bitumen represent the largest deposit types of recoverable hydrocarbons in the world. As an example, the proven, recoverable heavy oil reserves (including oil sands) in Alberta, Canada are greater that all of the light oil reserves of the Middle East. As used herein, heavy and extra heavy oil refers to a hydrocarbon-containing material having an American Petroleum Institute ("API") gravity, or specific gravity, of no more than about 22.5° API, and bitumen to a hydrocarbon-containing material having an API gravity of no more than about 10° API. By way of comparison, light crude oil is defined as having an API gravity higher than about 31.1° API, and medium oil as having an API gravity between about 22.3° API and 31.1° API. Bitumen will not flow at normal temperatures, or without dilution, and is "upgraded" normally to an API gravity of 31° API to 33° API. The upgraded oil is known as synthetic oil.

To recover heavy oil and bitumen, its viscosity is reduced. In one common commercial method of recovering heavy oil and bitumen, steam is injected under pressure into the oil-bearing formation. The steam heats up the formation, including the oil and/or bitumen, causing it to flow under the force of the steam (and other fluid(s)) pressure to a recovery well where it is pumped to the surface for refining. In one steam-assisted technique, known as SAGD, or Steam Assisted Gravity Drainage, steam is used to heat the oil which then flows downward (under the force of fluid pressure and gravity) to horizontal recovery wells placed beneath the oil formation. Another heavy oil recovery method ignites injected gas to create a high temperature, high pressure firefront which sweeps through the oil formation, pushing some of the oil ahead of it. In other heavy oil recovery methods, various forms of fluid injection (such as carbon dioxide, water, steam, surfactants (which reduce the viscosity of the fluid layer between the oil and the ground formation), alkaline chemicals, polymers, etc.) are performed.

The use of electromagnetic energy (usually electrical or Radio Frequency or RF) to heat the heavy oil formation has been known for several years. This technology was introduced during the 1970s when there was widespread interest in exploiting oil shale reserves. There have been several variations of this technology, ranging from relatively low frequency through radio frequency and microwaves. These have included multi-probe "closed" field heating arrangements, single probe heating arrangements, and radiating configurations.

By way of example, U.S. Pat. No. 2,799,641 to Bell discloses a method for production enhancement through electrolytic means whereby a direct electrical current causes oil flow through electro-osmosis. Another electro-osmosis technique is disclosed in U.S. Pat. No. 4,466,484 to Kermabon. Other disclosures (for example U.S. Pat. No. 3,507,330 to Gill, U.S. Pat. No. 3,874,450 to Kern, and U.S. Pat. No. 4,084,638 to Whitting) describe attempts to heat the near-wellbore region as well as more distant parts of the reservoir by electrical methods.

Kasevich in U.S. Pat. No. 4,301,865 disclosed the use of an underground array of RF emitting rods, which enclose a defined volume that is to be heated. The array is used specifically for the recovery of oil shale kerogen.

Bridges, et al., in U.S. Pat. Nos. 4,140,180; 4,144,935; 4,790,375; 5,293,936; 5,621,844; 4,485,868; and 5,713,415, disclose arrangements of underground RF heating elements and associated transformer and cable equipment, all applicable to volumetric heating of a closely defined space at or near the production well.

Elligsen, in U.S. Pat. No. 6,499,536, suggests the injection of RF absorbent materials in the well region as a means of enhancing the local heating effect.

Yuan, in U.S. Pat. No. 6,631,761, suggests the use of electrode configurations around the well as a means of further controlling the heating effect in conjunction with RF probes, such as those suggested by Bridges, et al.

Both Haagensen, in U.S. Pat. No. 4,620,593, and Jeambey, in U.S. Pat. No. 4,912,971, propose true underground antennas for RF (and microwave) heating. Haagensen further proposes a modified waveguide to be placed within the well casing. The waveguide, however, at the only available, relevant microwave frequency is still far too large to fit within any standard well casing.

U.S. Pat. No. 5,109,927 to Supernaw describes the use of a hypothetical directional antenna to direct energy selectively at the bottom region of a production zone to improve steam recovery.

In general, RF thermal stimulation techniques have encountered several pitfalls. These pitfalls include localized charring around the heating probes, limited field penetration, electrical downhole component failure, and the like. These pitfalls have led to improvements in electrical components as well as attempts to create a more uniform energy distribution throughout the heating zone.

The use of acoustic energy to stimulate heavy oil recovery has been known for a considerably long time. U.S. Pat. No. 3,378,075 to Bodine and U.S. Pat. No. 4,437,518 to Williams describe the use of sonic transmitters as a means of stimulating oil well production. U.S. Pat. No. 2,670,801 to Sherborne is one of the earliest disclosures of the use of sonic energy for this purpose. Wesley, in U.S. Pat. No. 4,345,650, further discloses the use of an explosive, ablative, electric spark as a means of generating a high-intensity acoustic wave at or near a subsurface oil formation to stimulate oil production.

More recently, U.S. Pat. Nos. 6,186,228 and 6,279,653 to Wegener, et al., disclose the use of electro-acoustic transmitters inside a wellbore to improve oil production from an oil-bearing formation. U.S. Pat. Nos. 6,227,293 and 6,427,774 to Huffman, et al., and Thomas, et al., respectively, describe a means of generating coupled electromagnetic and acoustic pulses to stimulate oil production at much greater distances from the wellbore than was previously possible using direct acoustic generation within the wellbore. It is speculative if the electromagnetic pulse so generated could retain appreciable power density at the extended distances exceeding 6,000 feet. Meyer, et al., in U.S. Pat. No. 6,405, 796, teaches the use of acoustic stimulation near the acoustic slow wave frequency in conjunction with fluid injection displacement as a means of stimulating oil flow. Abramov, et al., in U.S. Pat. No. 7,059,413, describe the use of a high intensity ultrasonic field near the bottom of the wellbore to generate heat and directly reduce the oil viscosity. This technique uses high frequency electrical heating of the well casing to maintain the oil at a relatively low viscosity.

Prior art techniques can have drawbacks.

The prior art techniques commonly use one or more stimulation techniques in conjunction with one or more wellbores drilled from the ground surface to intersect at least one oil-bearing stratum in a subterranean oil-bearing formation. The vertical string introduces several natural barriers which prevent the techniques from being commercially practical or at least introduces a large measure of additional cost or engineering difficulty related to energy loss and the necessity to locate the electrical equipment on the surface of the ground above the oil formation from where the energy must then be transmitted down a drill hole to access the oil formation. The barriers include inaccessibility of the stimulation device(s) after being placed, well completion at the surface and downhole end, operational unreliability of the stimulation device(s) and repair difficulties from location of the device(s) in the well casing, difficulty in keeping potentially harmful and/or flammable liquids from the device(s), well casing incompatibility with the stimulation actuators, creation of a means at the bottom of the drill casing whereby the energy can be transferred into the formation, and inability to recover the installed hardware. In particular, the limited size of standard drill casings, as well as the prohibitive cost of oversize casings, greatly restrict the size and complexity of components which can be reliably placed therein.

Prior art techniques seek to thermally stimulate the entire reservoir at one time followed by production from the entire reservoir over a period of up to five or ten years. To accomplish this, the entire reservoir must be thermally stimulated periodically over the production life of the reservoir. The unit of thermal energy required to produce a barrel of hydrocarbon-containing material can be relatively high. Moreover, heat can be lost heating up country rock and groundwater in proximity to the reservoir.

Many prior art techniques use vertical, rather than horizontal, hydrocarbon removal from the reservoir, along a typically long wellbore. Vertical hydrocarbon removal can raise recovery costs and lower recovery of hydrocarbons due to the pumping pressure and/or drive pressure (such as from steam introduced into the reservoir) required to overcome the effect of gravity.

Prior art techniques are generally unable to recover more than approximately 20% of the heavy oil in place, resulting in an overall inefficiency and loss of resource potential.

SUMMARY OF THE INVENTION

These and other needs are addressed by the various embodiments and configurations of the present invention. The present invention is directed to methods and systems for recovering hydrocarbon-containing materials, particularly heavy oil, bitumen, and kerogen, from subterranean formations. As used herein, a "hydrocarbon" is formed exclusively of the elements carbon and hydrogen. Hydrocarbons are derived principally from hydrocarbon-containing materials, such as oil. Hydrocarbons are of two primary types, namely aliphatic (straight-chain) and cyclic (closed ring). Hydrocarbon-containing materials include any material containing hydrocarbons, such as heavy oil, bitumen, and kerogen.

In one embodiment, a method for recovering a subterranean hydrocarbon-containing material is provided. The method includes the steps of:

(a) from a manned underground excavation in spatial proximity to a subterranean hydrocarbon-bearing formation, emitting radiation into a selected region of the formation to lower a viscosity of a hydrocarbon-containing material in the selected region; and (b) recovering, by a production well in proximity to the selected region, the irradiated hydrocarbon-containing material.

A "manned excavation" refers to an excavation that is accessible directly by personnel. In other words, the radiation emitters can be installed, accessed after installation, and removed by workers without the need of downhole devices, such as wireline devices. A typical manned excavation has at least one dimension normal to the excavation heading that is at least about 4 feet.

In one embodiment, the radiation has multiple, disparate wavelengths to provide synergistic viscosity effects. For example, one or more wavelengths are in the electromagnetic wavelength range, with microwave wavelengths being preferred, and one or more other wavelengths are in the acoustic energy range, with ultrasonic and supersonic wavelengths being preferred. Surfactants can be introduced into the hydrocarbon-bearing formation, in temporal proximity to radiation emission, to further decrease the viscosity of the hydrocarbon-containing material. As will be appreciated, a "surfactant" is a surface-active agent. The amount of surfactant needed to realize a desired degree of viscosity reduction is reduced synergistically by the application of acoustic energy to the formation.

The electromagnetic energy can heat the portion of the hydrocarbon-bearing formation beneath the waveguide assembly. The use of two parallel waveguide assemblies, for example, can make it possible to "sweep" the electromagnetic beam laterally so as to include a wider portion of the formation within the heated zone. The intent is not to heat the entire oil formation, as in other stimulation techniques, but to rapidly heat only a limited region within the formation.

The injected surfactant can provide a chemical accelerant which can reduce the surface bonding between the hydrocarbon-bearing material and the formation matrix material, which normally consists of sand and clay.

The ultrasonic transmitter can introduce high energy acoustic waves into the heated zone, which includes oil mixed with connate water and the injected surfactant within the formation matrix. The ultrasonic waves act to rapidly disperse the liquid surfactant and connate water and greatly reduce the viscosity of the heated oil directly at the interface between the oil and sand particles, thus causing the oil to flow more quickly through the formation matrix.

The overall result of the combination of these stimulation techniques is to cause a large fraction of the hydrocarbon-bearing material within the heated zone to migrate downward under the force of gravity for collection by a horizontal production well located immediately beneath the oil formation.

Through the techniques of the invention, substantial reductions in viscosity can be realized. Typically, the viscosity of the hydrocarbon-containing material, particularly heavy oil, bitumen, and kerogen, is reduced by at least about 200%, more typically by at least about 300%, and even more typically by at least about 350%. By way of example, the viscosity of the heavy oil, bitumen, and kerogen is reduced typically from a first viscosity of at least about 20,000 Cp to a second viscosity of no more than about 10 Cp.

Other advantages can also be realized by the present invention depending on the particular configuration. The invention can provide direct human access to the hydrocarbon-bearing formation, thereby removing the obstacles related to the downhole drill string. These obstacles include inaccessibility of the stimulation device(s) after being placed, well completion at the surface and downhole end, operational unreliability of the stimulation device(s) and repair difficulties from location of the device(s) in the well casing, difficulty in keeping potentially harmful and/or flammable liquids from the device(s), well casing incompatibility with the stimulation actuators, creation of a means at the bottom of the drill casing whereby the energy can be transferred into the formation, and inability to recover the installed hardware. This is made possible by using economical, modern tunneling technology, which, in turn, allows the introduction of much more reliable and efficient electromagnetic and acoustic stimulation techniques directly into the oil formation. The ability to access directly the formation can permit the various radiation emitters to be positioned manually and operated to provide a substantially uniform energy distribution throughout the selected region of the formation to be heated. The use of manned excavations, can remove limitations in conventional methods imposed on component size and complexity by the limited size of standard drill casings and the prohibitive cost of oversize casings. The invention normally does not seek to stimulate thermally the entire reservoir at one time. Rather, it stimulates preferentially only selected portions of the formation at one time, followed by production from that portion of the formation. Such selective stimulation can reduce, relative to conventional stimulation techniques, the energy required to produce a barrel of hydrocarbon-containing material. Unlike prior art techniques which use vertical, rather than horizontal, hydrocarbon removal from the reservoir, along a typically long wellbore, the invention can use, for hydrocarbon collection, a horizontal wellbore positioned in or below the hydrocarbon-bearing formation. Relative to conventional techniques, such horizontal removal can lower recovery costs and increase recovery of hydrocarbons. Finally, the invention can recover substantially, and normally several times, more than the approximately 20% of the heavy oil in place being recovered by conventional techniques.

These and other advantages will be apparent from the disclosure of the invention(s) contained herein.

As used herein, "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

It is to be noted that the term "a" or "an" entity refers to one or more of that entity. As such, the terms "a" (or "an"), "one or more" and "at least one" can be used interchangeably herein. It is also to be noted that the terms "comprising", "including", and "having" can be used interchangeably.

The above-described embodiments and configurations are neither complete nor exhaustive. As will be appreciated, other embodiments of the invention are possible utilizing, alone or in combination, one or more of the features set forth above or described in detail below.

DETAILED DESCRIPTION

Figure 1:
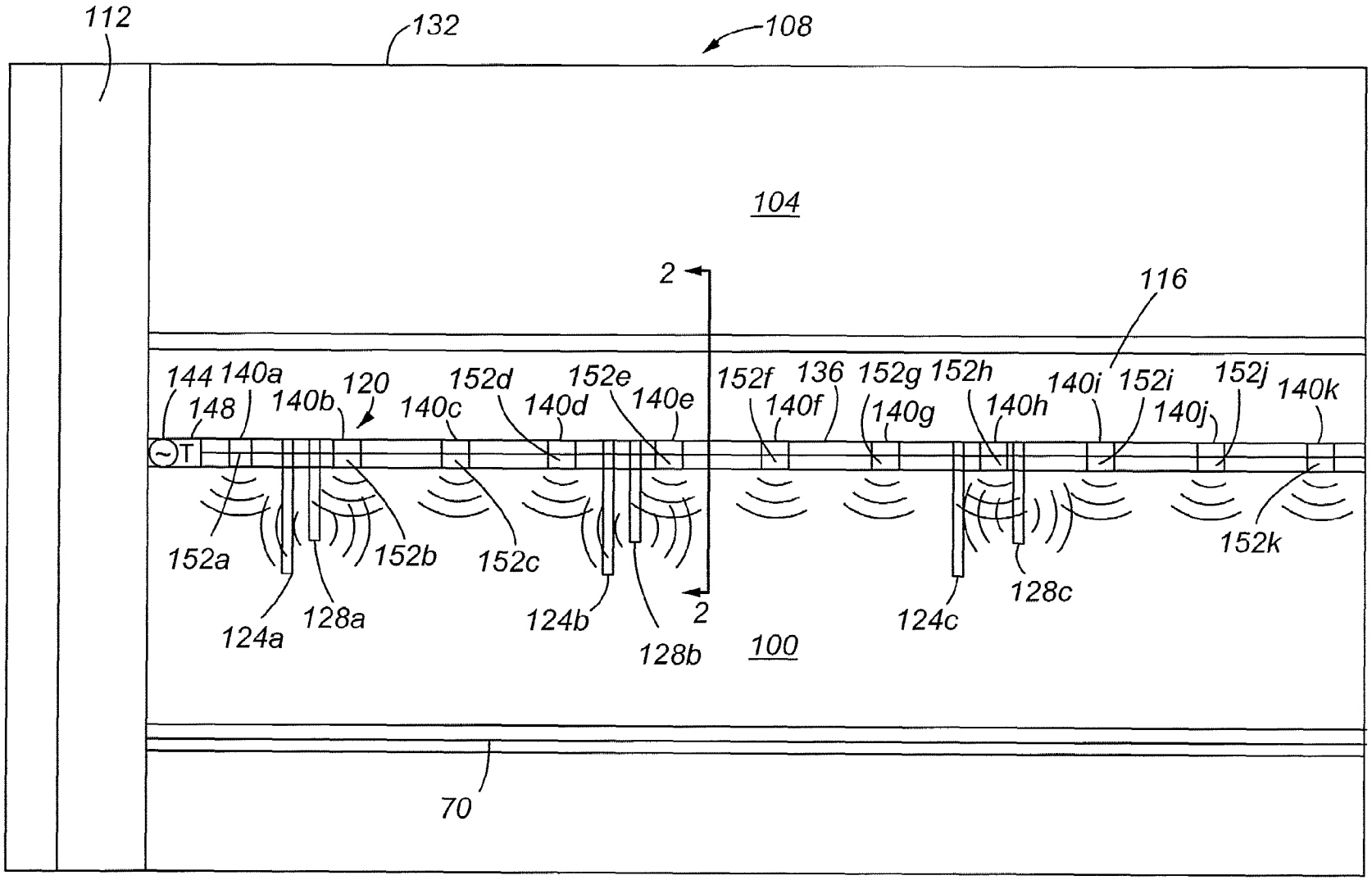
FIG. 1 is a cross-sectional side view taken along line 2-2 of FIG. 2 of an in situ hydrocarbon stimulation and production system according to an embodiment of the present invention.

In a preferred embodiment, in situ stimulation of a hydrocarbon-containing material, particularly heavy oil (otherwise known as low-API oil), is provided that includes the following operations:

1. Excavating a subterranean tunnel in or in proximity to the upper boundary of a hydrocarbon-bearing stratum or formation;
2. Placing one or more microwave waveguides disposed longitudinally along the bottom, side(s), and or top of said tunnel such that a face of the waveguide is in contact, either directly or indirectly, with the hydrocarbon-bearing formation;
3. Incorporating radiating slots or fixtures into the lower face of the waveguide;
4. Incorporating a medium material, or impedance transformer, between the waveguide and hydrocarbon-bearing formation to transfer efficiently microwave energy from the waveguide into the formation;
5. Energizing the waveguide using microwave energy in the frequency band from about 100 MHz to about 3000 MHz to heat locally a selected portion of the hydrocarbon-bearing formation in proximity to the said waveguide arrangement;
6. Inserting ultrasonic transmitters into the hydrocarbon-bearing formation along the bottom of the tunnel in proximity to the waveguide, the ultrasonic transmitters operating in the frequency band of from about 10 kHz to about 40 kHz;
7. Injecting, under high pressure, a surfactant (or similar surface tension adjusting) fluid into the hydrocarbon-bearing formation along the bottom of the tunnel;
8. Placing one or more recovery wells disposed substantially horizontally along the bottom boundary of the hydrocarbon-bearing formation and disposed substantially parallel to the tunnel;
9. Extracting the produced fluid(s), including the stimulated hydrocarbon-containing materials, connate water and surfactant fluids, using the recovery well; and
10. Making the extracted fluids available at the surface of the ground for treatment to separate at least most, and more preferably substantially all, of the extracted hydrocarbon-containing materials and to produce water suitable for subsequent treatment or use.

Many of the world's heavy oil deposits are located at relatively shallow depths (less than 2,000 feet) while others are much deeper. Shallow formations are problematic for conventional water flooding and steam injection stimulation production owing to poor ground competence and fracturing and channeling, all of which result in a very low net oil recovery. At greater depths, hot fluid injection techniques must suffer high energy losses on the downhole passage and other stimulation techniques, such as electrical and acoustic stimulation, are disadvantaged by power losses in connecting cables, breakage of cables, and actuator units, including electrical components, difficulty in precise placement and frequent inability to recover hardware.

In both the shallow and deep formation scenarios, nearly all of the attendant engineering and production difficulties can be eliminated if direct access can be gained to the hydrocarbon-bearing formation. Accordingly, the present invention creates an underground excavation, such as a tunnel, to provide access to the hydrocarbon-bearing formation from the ground surface. The excavation enables formation stimulation to substantially the entire hydrocarbon-bearing formation region of interest and, in doing so, enables a high net recovery of hydrocarbon-containing materials from the region, thereby depleting substantially the formation region. The excavation, in conjunction with the stimulation techniques disclosed herein, enables the sequential and systematic drainage of the hydrocarbon-bearing formation, section-by-section, without the need to stimulate simultaneously the entire formation region as is the case with other stimulation methods. Because of the relative inability of the natural high-viscosity hydrocarbon-containing materials to flow freely throughout the formation, there is little opportunity for the untapped hydrocarbon-containing materials in one region to backflow into an adjacent depleted region. Hydrocarbon recovery is, in one configuration, by means of a directionally drilled horizontal well placed at or near the bottom of the hydrocarbon-bearing formation "pay zone" and which essentially follows the tunnel direction.

As can be appreciated, the present invention is entirely compatible with conventional, surface-mounted, enhanced drive processes, such as gas injection, for the purpose of driving the liberated oil downward toward the producing well.

Figure 2:
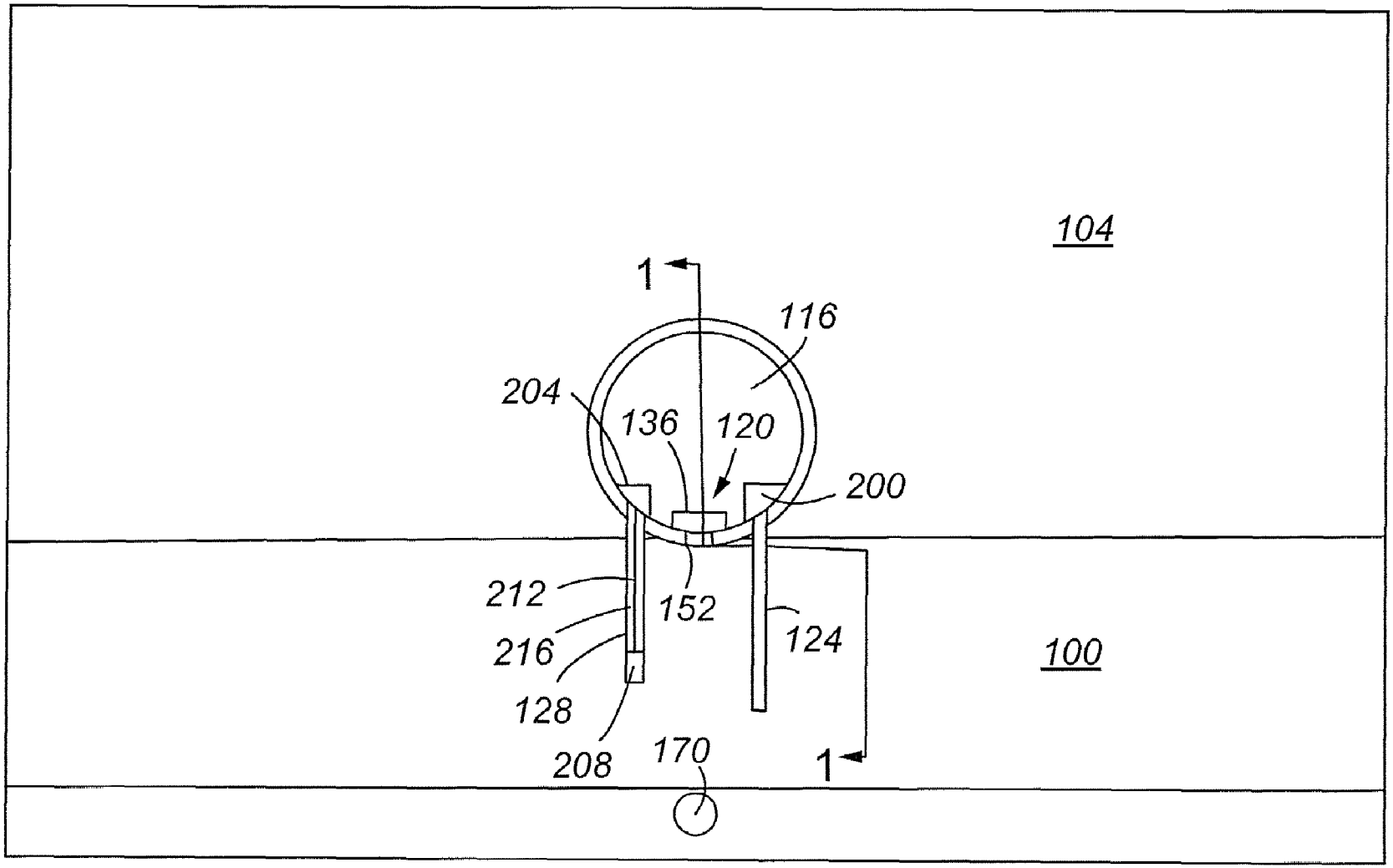
FIG. 2 is a cross-sectional front view taken along line 1-1 of FIG. 1 of the an in situ hydrocarbon stimulation and production system of FIG. 1.

Referring now to FIGS. 1-2, a stimulation and recovery system according to the preferred embodiment will now be described. The system is described in the context of a subterranean hydrocarbon-bearing formation 100, overlain by country or native rock 104. the formation 100 is normally relatively thin, being only a few feet thick, and may comprise several closely spaced zones.

The system 108 includes a lined access excavation 112, a lined stimulation excavation 116, an electromagnetic radiation generation, transmission, and irradiation assembly 120 extending a length of the stimulation excavation 116, surfactant injection wells 124*a-c* positioned at intervals along the length of the excavation 116, and acoustic energy emitters 128*a-c* also positioned at intervals along the length of the excavation 116.

The lined access excavation 112 may be any suitable excavation providing access from the surface 132. Examples include shafts, declines, and inclines.

The lined stimulation excavation 116 extends from the lined access excavation 112, is substantially sealed from fluids in the surrounding formations, and can be any suitable excavation that generally follows the strike and/or dip of the hydrocarbon-bearing formation 100. Examples of suitable excavations 116 include tunnels, stopes, adits, and winzes. The excavation 116 may be positioned above (as shown), in, or below the hydrocarbon-bearing formation 100. Preferably, the excavation 116 is placed along the top of the formation 100 so that the formation 100 is directly accessible at the excavation floor. The excavation is typically relatively small (e.g., from about 4 to about 15 feet and more typically from about 6 to about 8 feet in diameter), is lined with a liner such as concrete or cement, and is suitably reinforced and fitted with apertures in the liner to expose the formation 100 to radiation emitters.

The electromagnetic radiation generation, transmission, and irradiation assembly 120 imparts one or more selected wavelength bands of electromagnetic radiation to a selected portion or region of the hydrocarbon-bearing formation 100. As will be appreciated, the higher the frequency of the electromagnetic radiation the higher the attenuation and lower the penetration depth in the formation, and the lower the frequency the lower the attenuation and higher the penetration depth in the formation. The frequency of the radiation preferably ranges from about Direct Current (DC) to about 10 GHz, more preferably in a power frequency band of from about DC to about 60 Hz Alternating Current (AC), in the short wave band of from about 100 kHz to about 100 MHz, and/or in the microwave band of from about 100 MHz to about 10 GHz, with the microwave band in the range of from about 100 MHz to about 3 GHz being particularly preferred.

When the radiation is in the microwave band, the assembly 120 includes a waveguide 136 having multiple, regularly spaced antenna or radiating elements 140*a-k*, a generator 144, and timer 148. The waveguide 136 can have any suitable configuration for the set of radiation frequencies to be transported by the waveguide 136. For example, an exemplary waveguide could include a metal cylinder having any desired cross sectional shape, which is commonly rectangular. Likewise, the particular configuration of the antenna elements depends on the particular set of radiation frequencies to be emitted. For example, each element can be configured as a resonant slot. In one configuration, the emitted electromagnetic radiation (shown as arcs emanating from each element 140) is a set of different frequencies having differing penetration depths into the formation to heat the formation to differing degrees. As will be appreciated, lower frequencies travel with less attenuation than higher frequencies in the formation. The generator 144 can be any suitable generating device, such as a magnetron or klystron. Finally, the tuner 148 can be any suitable tuning device to provide propagation characteristics in the waveguide that reduce substantially, or minimize, reflected electromagnetic radiation. The tuner 148, for example, may be a tunable dielectric material, such as a thin or thick film or bulk ferrite, ferromagnetic, or non-ferrous metallic material.

Each of the antenna elements 140*a-k* has a corresponding impedance transformer 152*a-k* positioned in the excavation liner to match the waveguide field impedance to the impedance of the formation 100 and couple the electromagnetic radiation to the adjacent formation. Because the formation 100 is directly accessible through the liner of the excavation, there is no need to drill holes for placement of the antenna elements within the formation, as is the case with all other RF or microwave stimulation methods. Furthermore, the assembly 120 is completely removable at the completion of the stimulation process.

Although any suitable impedance matching material or materials may be used, a preferred impedance transformer

152*a-k* is a "pillow" block of a special material, such as a ceramic material, that interfaces between the waveguide and the formation 100. The principal property of the impedance transformer is its intrinsic impedance, which must be designed to fall at approximately the average value of the two impedances being "matched", in this case the typically air-filled waveguide (having an intrinsic impedance of about 377 ohms) and the formation 100 whose intrinsic impedance is given by:

$$\eta=\sqrt{(j\omega\mu)/(\sigma+j\omega\epsilon)}$$

where $\omega=2\pi f$ is the radian frequency f=915 MHz $\mu$=permeability of free space $\sigma=0.001$ is the medium conductivity $\epsilon=(20-j0.45)\times 8.854\times 10^{-12}$ is the medium permittivity The permittivity value is dependent on temperature, frequency, and the relative soil/water ratio, which, for a typical heavy oil formation, yields an impedance of approximately 80 ohms. A preferable transformer therefore has a stepped or graded impedance from about 377 ohms to about 80 ohms. Alternatively, the impedance transformation may be incorporated into the antenna element by designing the radiating slots in the waveguide to have a low near-field impedance, i.e., a ratio of electric to magnetic field magnitudes of the order of about 80. In this manner, the electromagnetic energy may be coupled efficiently to the formation 100.

The antenna elements 140*a-k* preferably intermittently emit radiation into the hydrocarbon-bearing formation. Beam steering or scanning techniques may be employed to direct the radiation into selected areas but not in others and/or to direct differing amounts of radiation into differing areas. By way of example, rather than irradiating in a 180 degree arc as shown beam steering may be used to irradiate in a 90 degree arc. In another example, the radiation may be beam steered so that it emanates from the antenna element in the same manner as a windshield wiper moving across a car's windshield.

As will be appreciated, a system of sensors (not shown) embedded in the hydrocarbon-bearing formation 100 and computer (not shown) can be used to control generation and emission of electromagnetic radiation from the assembly 120. The computer receives control feedback signals from an interface that is connected to telemetering lines (not shown). The telemetering lines are in turn connected to the sensors. Each sensor monitors the amount of radiation reaching the underground location where that sensor is located and/or the formation temperature at that location. Preferably, the formation temperature in the selected formation region is maintained from about 200 to about 350 degrees Celsius and even more preferably from about 250 to about 300 degrees Celsius. At these temperatures, the heavy oil and bitumen normally has a viscosity of no more than about 10 Cp and even more normally of from about 1 to about 5 Cp.

In one operational configuration, the generator 144 is turned on and off to emit radiation into the formation 100 only during selected, discrete time periods. The time periods may of uniform length or differing lengths depending on the application. It is believed that intermittent irradiation of the selected region of the formation 100 can produce a flow of hydrocarbon-containing material that is greater than that produced by continuous irradiation of the region. Intermittent irradiation of the deposit further represents a lower consumption of thermal energy to recover a selected volume of hydrocarbon-containing material and prevents overheating near the antenna elements, thereby allowing the deposited heat energy to dissipate through the selected formation region and making maximum use of the available microwave power.

In one operational configuration, the radiation is emitted, at least initially, at incrementally increasing radiation power. As in the prior embodiment, the radiation may be emitted intermittently.

In one operational configuration, alternate sets of antenna elements are energized at different times. In other words, a first set of antenna elements are energized at a first time while a second set of antenna elements are energized at a second, normally nonoverlapping, time. This permits the emitted microwave energy to affect a larger portion of the formation and allows the heat to dissipate into the formation between alternating cycles.

The action of the radiated electromagnetic radiation heats the fluids within the formation 100 (water and asphaltenes are good receptors), thereby substantially reducing fluid viscosity. For a single waveguide, the affected heated region will be the angular bandwidth directly beneath the waveguide, being approximately +/−60 degrees from the vertical (normal) direction. Given the relatively small thickness of the typical formation "pay zone", the use of microwave frequencies is beneficial since there is no need to transmit high power densities over long distances as is the case with all other RF and microwave heating techniques. This makes it possible to take advantage of the high absorption of receptive oil and water molecules at these frequencies.

The surfactant injection wells 124*a-c* introduce, under pressure (via pump 200), an aqueous solution including one or more surfactants into the formation 100. The primary purpose of the aqueous fluid is not to effect a bulk fluid displacement of the hydrocarbon-containing material but rather, in synergistic combination with the acoustic and microwave stimulation, to reduce effectively the hydrocarbon-containing material viscosity and enhance its release from the formation matrix. This may, for example, result from the creation of fluid flow channels through the thickness of the pay zone, which are known to enhance the effectiveness of acoustic stimulation. Unlike most other fluid transport enhancement techniques, the occurrence of "channeling" is not detrimental in the present invention and the fluid flow direction is downward under the force of gravity instead of laterally between vertical wells. In this respect, the invention is somewhat similar to gravity drainage.

The surfactant can be any substance that reduces surface tension in the hydrocarbon-containing material or water containing the material, or reduces interfacial tension between the two liquids or one of the liquids and the surrounding formation. For example, the surfactant can be a detergent, wetting agent or emulsifier. Preferred surfactants include aqueous alkaline solutions (formed from hydroxides, silicates, and/or carbonates), oxygen-containing organic products of the oxidation of organic compounds (e.g., oxygen-containing functional groups, such as aldehydes, ketones, alcohols, and carboxylic acids, that are more soluble and polar than the original organic compound), demulsifiers (such as pine oil and other terpene hydrocarbon derivatives), and mixtures thereof.

The concentration of surfactant required is lowered due to the synergistic combination of surfactant with acoustic energy.

The acoustic energy emitters 128*a-c* introduce acoustic energy (shown by arcs emanating from emitters) into the formation 100 to disperse the surfactant and effect viscosity reduction of the hydrocarbon-containing material. While not wishing to be bound by any theory, it is believed that a sound wave passing through a viscous liquid, such as water, causes a vibration pattern that sets the liquid in motion. Acoustic vibration patterns form water molecule layers that stretch, compress, bend, and relax. Interacting layers generate tiny vacuum spaces called cavitations within the liquid. Imploding cavitations scrub surfaces and pull away foreign matter.

It is postulated that when acoustic energy is applied to a hydrocarbon-bearing formation one or more of the following changes in formation properties is realized: alteration of reduction in adherence of wetting films to the rock matrix due to nonlinear acoustic effects (such as in-pore turbulence, acoustic streaming, cavitation, and perturbation in local pressures), reduction in surface tension, density, and viscosity from heating by acoustic energy, increased solubility of surfactants and reduction of adsorption of surface-acting components, deposition of paraffin wax and asphaltenes, permeability and porosity increase due to deformation of pores and removal of fine particles or increase in the flow by reduced boundary layer of immobile phase, reduction of capillary forces due to the destruction of surface films, coalescence of hydrocarbon-containing material drops due to the Bjerknes forces that cause a continuous stream of water, oscillation and excitation of capillary trapped hydrocarbon-containing material drops due to forces generated by cavitating bubbles and acoustic/mechanical vibration in the rock and fluids, emulsification generated by intense sound vibration and the presence of natural or introduced surfactants, sonocapillary effects, and/or peristaltic transport caused by the deformation of the pore walls.

Which effect(s) predominates depends on the frequency and intensity of the acoustic energy. At higher intensity, mechanical stresses increase markedly and therefore temperature increases. Frequency can play an important role in wave dispersion, attenuation, and heat dissipation.

Although acoustic energy frequencies in the subsonic and lower and upper sonic bands may be employed, the preferred frequency of acoustic energy is in the ultrasonic or supersonic frequency spectrum and the intensity of the energy is at least about 10 watts per square inch and more preferably ranges from about 50 to about 100 watts per square inch in the immediate vicinity of the acoustic transducer. The acoustic energy can be in analog (sinusoidal) or digital (pulsed) form. Digital acoustic energy permits adjustment of the cavitation response for the specific application.

In one configuration, multiple acoustic energy frequencies are intermixed to use multiple of the effects noted above. In this configuration, complex or modulated vibrational waves are derived from the combination of multiple sinusoidal waves of dissimilar frequencies. The wave components of the complex wave may bear a harmonic relationship to one another, i.e., the frequency of all but one (the fundamental wave) of the component waves may be an integral multiple of the frequency of the one fundamental wave. Such complex waves may be formed by the use of multiple wave generators.

Each emitter 128 includes a power source 204, a wave generator 208, a transducing medium 216, and a coupler 212 between the power source 204 and generator 208. Although the emitters 128 are depicted as being positioned in a drilled hole, it is to be understood that the emitters 128 can be in the form of flat plate transducers that are bolted or otherwise secured to the formation. The use of flat plates is permitted because the formation 100 is accessible through the liner. Upon completion of the stimulation procedure, the emitters are dismounted and reused elsewhere.

The power source 204 can be mechanical (e.g., an engine or motor) or electrical (e.g., a generator, battery, capacitor bank, etc.).

The generator 208 can be mechanically or electrically driven and capable of introducing large amounts of acoustic energy into the formation 100.

Suitable mechanical generators 208 include, for example, sonic pump and motor assembly. In one example of a mechanical wave generator, a motor and generator assembly is located at in the stimulation excavation. The motor (or power source 204) rotates a cam (not shown) to effect vertical movement of a roller bearing resting on the cam. The roller bearing is fastened to a rod that is pivoted about a point and is counterbalanced by an adjustable weight. A further coupling rod is attached to the rod by a pivot. The rotation of the cam produces a reciprocating motion of the rod through the bearing. The motion is transmitted by the coupling rod to the transducing medium in the drilled hole, which releases acoustic energy into the formation 100. The preceding exemplary generator, and other possible mechanical generator designs, are discussed in U.S. Pat. No. 2,670,801, which is incorporated herein by this reference.

Suitable electrical generators 208 include sonic and supersonic horns, piezo-electric crystals coupled with low or high frequency oscillating electrical currents, magneto-restrictive devices positioned in an alternating magnetic field, and the like.

The transducer or transducing medium 216 is preferably a solid or liquid medium. Under certain conditions, such as those prevailing in high pressure formations, gaseous media may be used. The transducing medium 216 may be, for example, water and other liquids, cement or concrete, plastic, melted or solidified alloys, or some other material lodged within or in the vicinity of the formation 100.

The relative timing of surfactant injection and acoustic energy emission depends on the application. The surfactant may be injected before and/or during acoustic energy emission. In one configuration, the surfactant is injected at a point called the acoustic slow wave point at which the motion of the solid and pore liquid is 180 degrees out of phase. At this point, the pore liquid and solid have the maximum amount of relative motion. When excited at the slow wave frequency, on alternate sound wave half cycles, the maximum amount possible of pore fluid is moved from previously inaccessible pores adjacent to the percolation flow path into the flow path for removal and collection. On intervening acoustic wave half cycles, fluid containing surfactants from the percolation flow path is injected into the surrounding pores in the rock, thus increasing the size of the percolation flow domain. Accordingly, both ultrasound half cycles perform useful functions for secondary oil recovery; that is, removing previously inaccessible oil from rock surrounding the percolation flow path and enlarging the area of the oil reservoir accessible to surfactants and percolation flow. Regardless of the particular timing of surfactant injection and acoustic energy emission, viscosity reduction can be substantial, with a reduction of at least four orders of magnitude being possible.

The hydrocarbon material, after exposure to the electromagnetic radiation and acoustic energy and contact with the surfactant, flows to a production well 170 positioned in proximity to the excavation 116 and generally having a bearing parallel to the bearing of the excavation 116. The production well 170 is preferably formed by directional drilling techniques and located within the stimulated region, or irradiated region, of the formation 100. When the formation 100 comprises multiple zones, the well 170 is placed beneath the lowermost zone. The production well 170 is cased with a well casing (not shown) which extends from the surface to a position proximal to the formation 100, and a perforated liner 51 containing perforations (not shown) through which the hydrocarbon-containing material flows and is collected by the well 170. Pump tubing (not shown) extends into the well 170 and is fitted with a standing valve (not shown) that permits an upward liquid flow and prevents reverse flow. The upward flow is maintained by a traveling valve (not shown) which is actuated by a sucker rod (not shown). The sucker rod is in turn actuated by a motor (not shown) at the surface 132. The well casing is sealed with a casing head (not shown). The casing head is fitted with a packing gland (not shown) through which the pump tubing passes. The collected hydrocarbon-bearing material is stored at the surface 132 in a storage tank (not shown).

Figure 3:
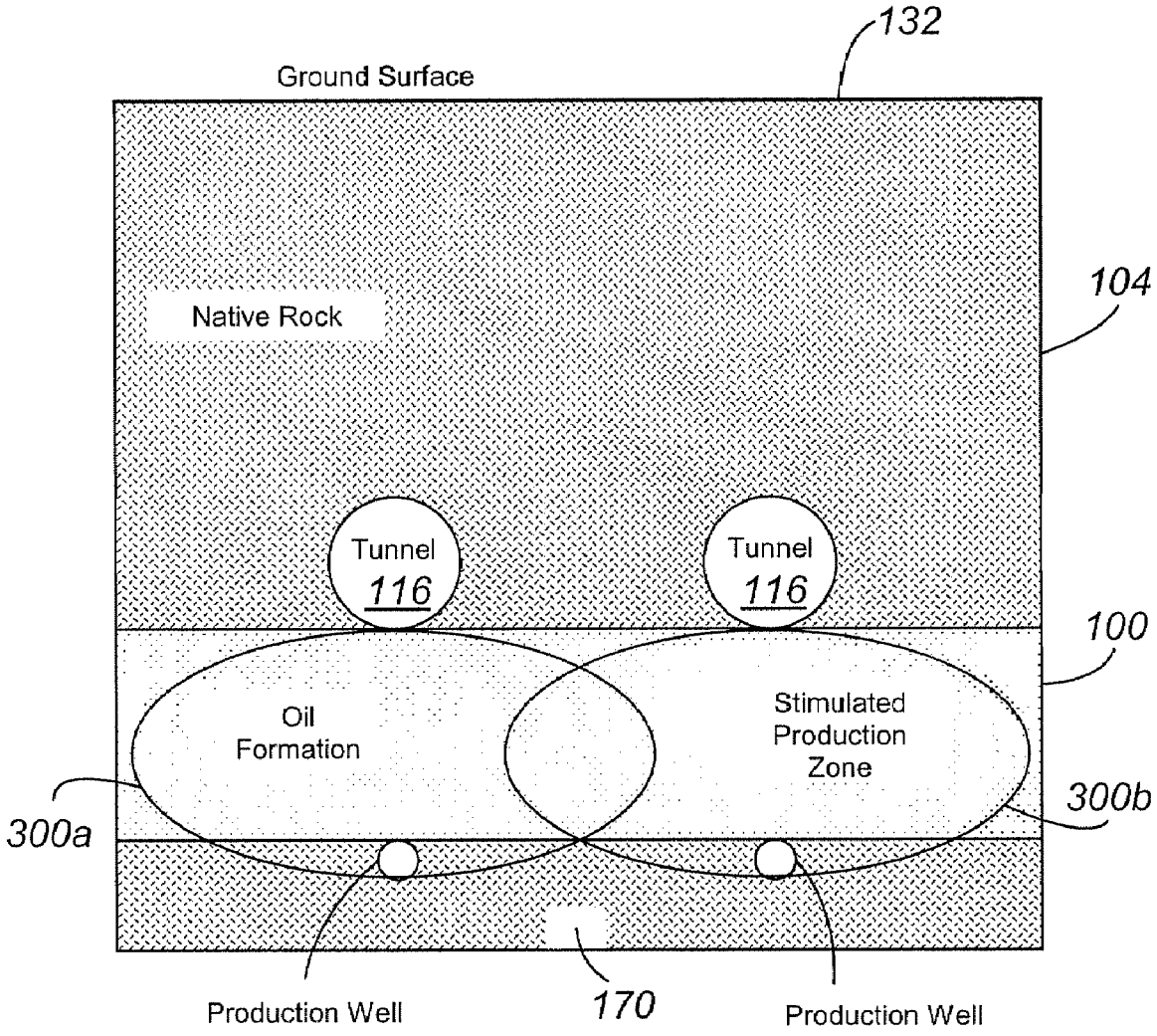
FIG. 3 is a cross-sectional front view of multiple underground excavations according to an embodiment of the present invention.

With reference to FIG. 3, multiple stimulation excavations 116 (which typically originate from a common access excavation) are generally needed to exploit the full width of the formation 100. In this situation, adjacent excavations 116 are situated such that the stimulated regions 300*a* and *b* overlap, leaving only a very small portion of the pay zone as unrecovered. Typically adjacent excavations 116 are substantially parallel and separated by distances of approximately 300 to approximately 500 feet.

To facilitate a more efficient electromagnetic heating effect and substantially minimize the unrecovered portion of the pay zone, the electromagnetic beam is steered laterally (in a cross-excavation direction) by incorporating a second waveguide (not shown) along the excavation floor alongside the first waveguide and separated from the first by a distance of at least about 4 inches (or about one-quarter wavelength at the microwave frequency of 915 MHz). By adjusting the relative phase of the microwave signals in the adjacent waveguides, one may effectively steer the radiation beam so as to increase the lateral coverage and enable a wider tunnel separation, with only a substantially minimal amount of unrecoverable pay zone. As will be more fully disclosed below, net hydrocarbon-containing material recoveries approaching 80% may be realized, and in much shorter time periods, than is possible with other stimulation methods.

As will be understood by one familiar with the prior art, there is considerable advantage to the simultaneous combination of electromagnetic, acoustic, and fluid stimulation techniques as disclosed herein.

EXPERIMENTAL

Example 1

Extensive computer reservoir modeling analyses were conducted for several heavy oil scenarios in Cold Lake, Alberta, Canada to evaluate the expected performance of microwave stimulation. The reservoir parameters are as follows:

| | |
|---|---|
| Pay zone thickness | 20 m |
| Porosity | 0.35 |
| Permeability | 2,200 md |
| Res. Temperature | 13 degrees Celsius |
| Viscosity (live oil) | 22,000 cp @ 20 degrees Celsius |
| | 950 cp @ 50 degrees Celsius |
| | 43 cp @ 100 degrees Celsius |
| BHP | 500 kPa |
| Water Saturation | 0.26 |
| Oil Saturation | 0.327 |
| Pore Volume | 0.446 |

Figure 4:
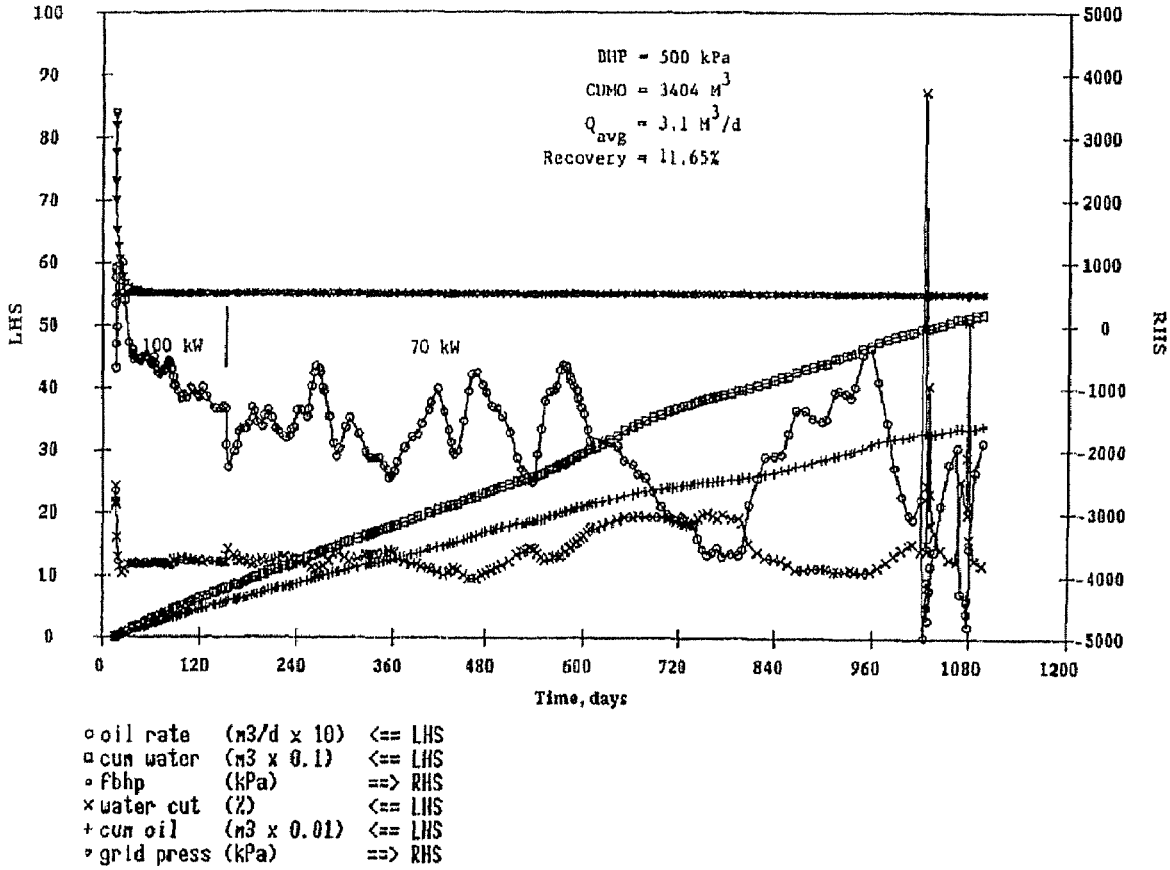
FIG. 4 shows the simulated production performance of a microwave stimulated Cold Lake reservoir, single 100 kW injector with vertical production

A single vertical microwave (915 MHz) emitter was located in the center of a cylindrical test area with diameter 150 meters. Oil "recovery" was modeled as oil which reached the bottom of the test cylinder. The cylinder bottom coincided with the bottom of the pay zone. The simulation was run with 100 kW of microwave power for the first 150 days and 70 kW thereafter. Microwave power was switched on and off according to a set thermostat temperature of 300 degrees (max) to 280 degrees Celsius (minimum). The simulation run time was three years (FIG. 4). Cumulative oil production was 3,404 cubic meters in 1095 days, average rate 3.10 cubic meters/day, and a cumulative recovery of 11.65%.

Example 2

Figure 5A:
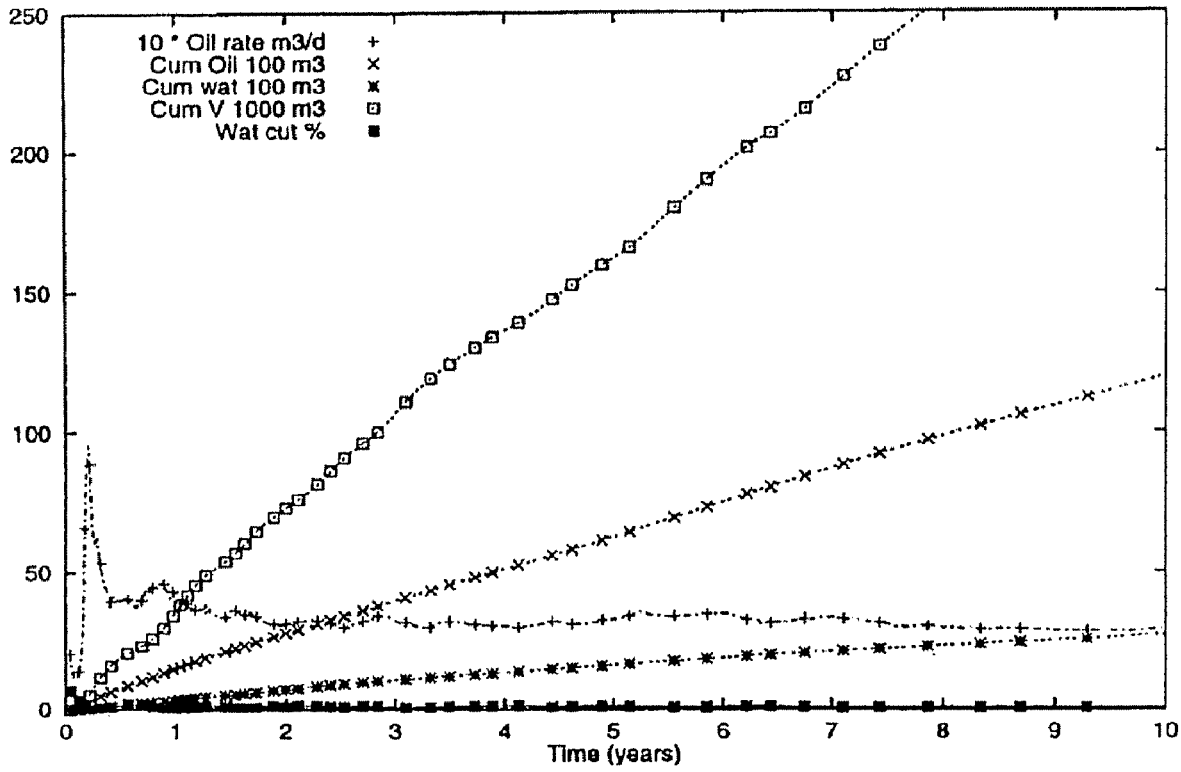
FIGS. 5A and 5B show the simulated production performance of a microwave stimulated Cold Lake reservoir, single 100 kW injector with horizontal production.
Figure 5B:
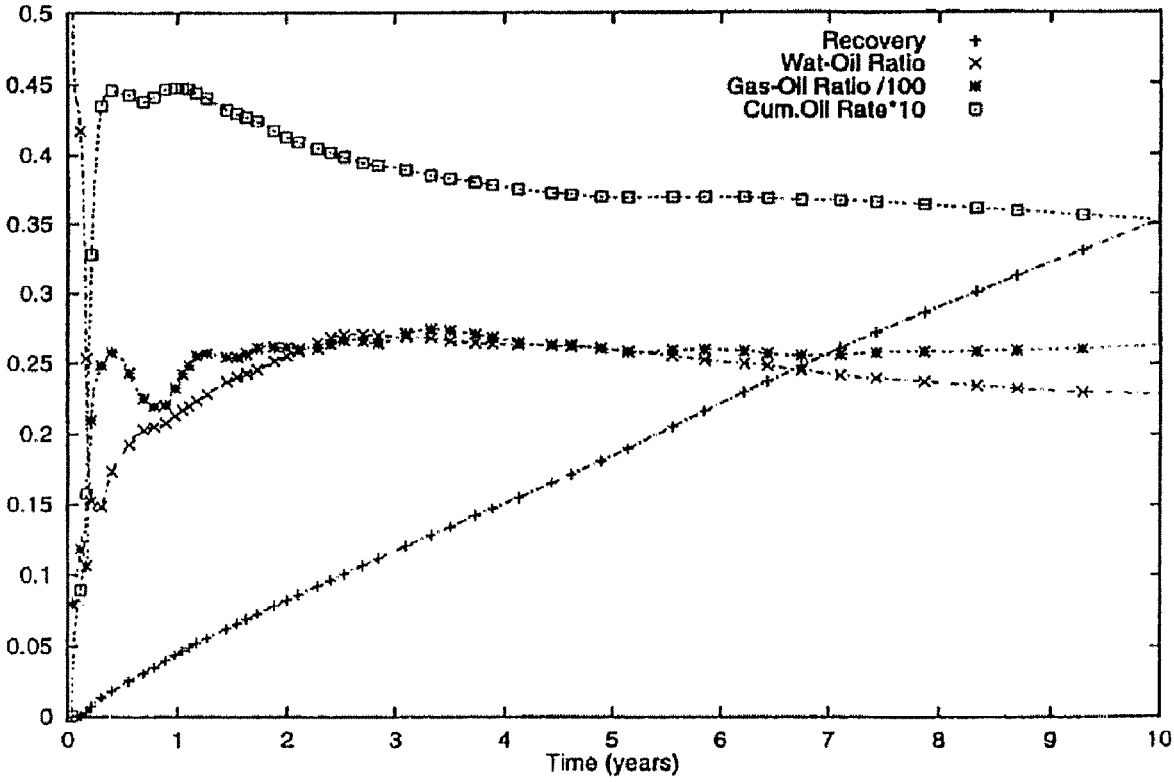

For the same Cold Lake reservoir parameters as in Example 1, a single microwave emitter (100 kW at 915 MHz) was located at the center of a 150 m by 150 m area directly above a horizontal recovery well, which was located at the bottom of the pay zone. The microwave power supply was thermostatically controlled as in Example 1. The simulation time was 10 years (FIGS. 5A and 5B). Average oil production was 3.28 cubic meters/day, and the cumulative recovery was 35.3%.

Example 3

Figure 6:
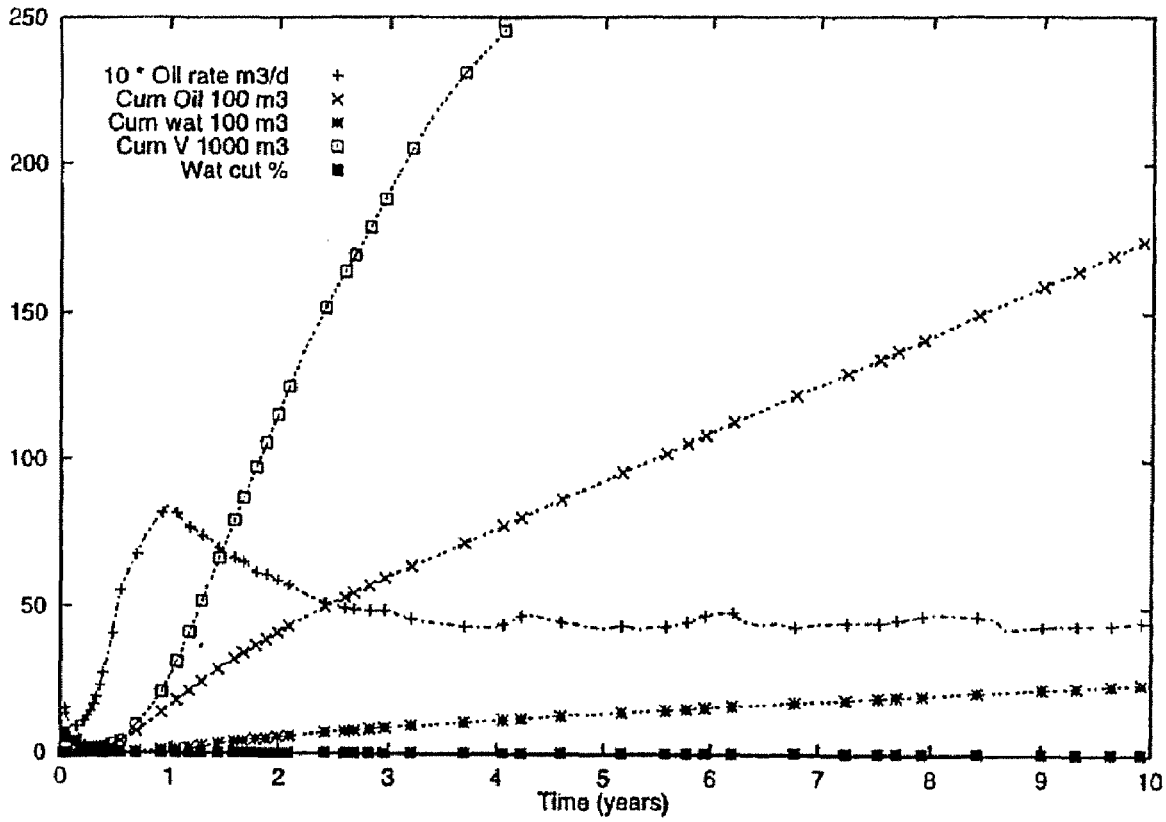
FIG. 6 shows the simulated production performance of a microwave stimulated Cold Lake reservoir, with four 25 kW injectors with horizontal production.

For the same Cold Lake reservoir arrangement as in Example 2, an arrangement of four vertical microwave emitters were positioned 25 m apart and along a horizontal recovery well. Each injector antenna provided 25 kW of microwave power at 915 MHz and the sources were thermostatically controlled as in Example 1. The simulation time was 10 years (FIG. 6). Average oil production rate was 4.80 cubic meters/day, and the cumulative recovery was 59.7%.

A number of variations and modifications of the invention can be used. It would be possible to provide for some features of the invention without providing others.

For example in one alternative embodiment, the surfactant is not injected into the formation 100 but is generated in situ by hydrous pyrolysis/partial oxidation of constrained organics, such as petroleum and petroleum products, including fuel hydrocarbons, polycyclic aromatic hydrocarbons, chlorinated hydrocarbons, and other volatile materials. The materials are contained in groundwater in the formation 100. When oxidized, the organic material produces intermediate oxygenated organic compounds, e.g., surfactants and precursors thereof. The intermediate oxygenated organic compounds, as noted above, have oxygen-containing functional groups, such as aldehydes, ketones, alcohols, and carboxylic acids. The surfactants are formed in situ by introducing into the formation 100 an oxidant, such as steam (or air) and/or mineral oxidants, a catalyst of the organic partial oxidation (such as manganese dioxide or ferric oxide), and thermal energy in the form of electromagnetic radiation.

In another alternative embodiment, the various elements noted above, namely electromagnetic radiative heating, acoustic energy stimulation, and surfactant injection are used alone or in any combination to stimulate the reservoir.

The present invention, in various embodiments, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, includes providing devices and processes in the absence of items not depicted and/or described herein or in various embodiments hereof, including in the absence of such items as may have been used in previous devices or processes, e.g., for improving performance, achieving ease and\or reducing cost of implementation.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Moreover, though the description of the invention has included description of one or more embodiments and certain variations and modifications, other variations and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A method for recovering a subterranean hydrocarbon-containing material, comprising:

(a) from a manned underground excavation emitting, from at least first and second emitters, radiation, the first emitter transmitting microwave radiation and the second emitter transmitting acoustic energy into a selected region of a subterranean hydrocarbon-bearing formation, to heat and lower a viscosity of a hydrocarbon-containing material in the selected region, wherein at least one of the first and second emitter is positioned in the excavation and in direct physical contact with the formation, wherein the first emitter is in contact with an impedance transformer, the transformer being in direct physical contact with the formation and wherein an acoustic energy transducing medium is in direct physical contact with the formation; and (b) recovering, by a production well in proximity to the selected region, the irradiated hydrocarbon-containing material.

2. The method of claim 1, wherein the microwave radiation has a frequency ranging from about 100 MHz to about 3000 MHz, wherein the microwave radiation has a plurality of frequencies having differing penetrating depths into the formation, wherein the impedance transformer has an intrinsic impedance between 377 ohms and an impedance of the formation, wherein the radiation is microwave radiation, wherein the microwave radiation is emitted by discrete antenna elements positioned along a waveguide positioned in and spanning a selected length of the excavation, and wherein at least a portion of the production well is positioned below the selected region.

3. The method of claim 1, wherein the microwave radiation has a frequency ranging from about 100 MHz to about 3000 MHz, wherein the microwave radiation has a plurality of frequencies having differing penetrating depths into the formation, and wherein the emitted acoustic energy is in the form of a sinusoidal waveform.

4. The method of claim 1, wherein the acoustic energy has a frequency ranging from about 10 to about 40 kHz, and wherein the impedance transformer is a transducing medium, through which the acoustic energy passes, and wherein the transducing medium is in direct physical contact with the formation.

5. The method of claim 4, further comprising:

(c) introducing a surfactant into the selected region before and/or during step (a).

6. The method of claim 1, wherein the excavation follows generally at least one of a strike and dip of the formation.

7. The method of claim 4, wherein the acoustic energy has a frequency in the ultrasonic band.

8. A method for recovering a subterranean hydrocarbon-containing material, comprising:

(a) introducing a surfactant into a selected region of a subterranean hydrocarbon-bearing formation;

(b) from a manned underground excavation, emitting acoustic energy into the selected region to lower a viscosity of a hydrocarbon-containing material in the selected region, wherein the underground excavation has a dimension normal to a heading of the excavation of at least about four feet;

(c) from the manned underground excavation, emitting microwave energy into the selected region to heat the hydrocarbon-containing material in the selected region, wherein the emitted acoustic energy lowers the viscosity of the heated hydrocarbon-containing material; and (d) recovering, by a production well in proximity to the selected region, at least a portion of the hydrocarbon-containing material.

9. The method of claim 8, wherein the micro wave radiation has a frequency ranging from about 100 MHz to about 3000 MHz, wherein the microwave radiation has a plurality of frequencies having differing penetrating depths into the formation, wherein the emitted acoustic energy is in the form of a sinusoidal waveform, wherein the acoustic energy has a frequency in the ultrasonic spectrum, wherein the acoustic energy is emitted by an emitter positioned in the underground excavation, and wherein the emitter is one of in contact with and proximal to the formation.

10. A method for recovering hydrocarbon-containing materials, comprising:

(a) introducing a surfactant into a selected region of a hydrocarbon-bearing formation, the formation comprising at least one hydrocarbon-containing material;

(b) while the surfactant is in the selected region, passing acoustic energy through the selected region of the formation;

(c) passing, from the manned underground excavation, microwave radiation through the selected region of the formation, wherein an impedance transformer is in contact with a microwave transmitter and physical contact with the hydrocarbon-bearing formation; and (d) thereafter recovering the at least one hydrocarbon-containing material.

11. The method of claim 10, wherein the acoustic energy has a frequency in the ultrasonic spectrum.

12. The method of claim 11, wherein the microwave radiation has a frequency ranging from about 100 MHz to about 3000 MHz, wherein the microwave radiation has a plurality of frequencies having differing penetrating depths into the formation, wherein the microwave radiation is emitted by discrete antenna elements positioned at selected intervals along a waveguide, the wave guide being positioned in the manned underground excavation, the manned underground excavation being positioned in or proximal to the formation, and wherein the underground excavation has a dimension normal to a heading of the excavation of at least about four feet.

13. A system for recovering hydrocarbon-containing materials, comprising:

(a) a hydrocarbon-bearing formation comprising a hydrocarbon-containing material;

(b) a manned underground excavation;

(c) in the manned underground excavation, at least one microwave radiation emitter to direct radiation into the formation; and (d) in the manned underground excavation, at least one acoustic energy emitter to direct acoustic energy into the formation, wherein the emitted acoustic energy is in the form of a sinusoidal waveform.

14. The system of claim 13, wherein the microwave radiation has a frequency ranging from about 100 MHz to about 3000 MHz, wherein the microwave radiation has a plurality of frequencies having differing penetrating depths into the formation, wherein the acoustic energy has a frequency ranging from about 10 to about 40 kHz, wherein the underground excavation is lined by a liner, and wherein the liner comprises a passage for the electromagnetic emitter and/or an impedance transformer in contact therewith to contact physically the formation.

15. The system of claim 13, wherein the underground excavation is lined by a liner, and wherein the liner comprises a passage for the acoustic energy emitter and/or an transducing medium in contact therewith to contact physically the formation.

16. The system of claim 14, wherein the microwave radiation emitter comprises spaced apart antenna elements and further comprising, a generator, a waveguide, an impedance transformer, and a tuner, wherein the waveguide electrically connects the generator and tuner with the antenna elements, wherein the impendance transformer matches a waveguide field impedance to an impedance of the formation, wherein the impedance transformer has an intrinsic impedance between 377 ohms and an impedance of the formation, and further comprising:

(e) a production well, at least a portion of which is positioned below the formation.

17. The system of claim 16, wherein the at least a portion of the production well is generally parallel to a heading of the excavation.

18. The system of claim 17, wherein the at least a portion of the production well is substantially horizontal.

19. The system of claim 13, further comprising:

(e) a plurality of sensors positioned at different locations in the formation, the sensors measuring at least one of temperature and an amount of radiation passing through an area proximal to the sensor; and (f) a computer operable to receive signals from the temperature sensors and, in response thereto, control operation of the at least one of the microwave radiation emitter and acoustic energy emitter, wherein a temperature of the formation is maintained at a temperature ranging from about 200 to about 350° C.

20. The method of claim 1, wherein the impedance transformer has at least one of a stepped and graded impedance ranging from about 377 to about 80 ohms.

21. The system of claim 16, wherein the impedance transformer has at least one of a stepped and graded impedance ranging from about 377 to about 80 ohms.

22. The method of claim 1, further comprising:

at least one of beam steering and scanning the microwave energy to selected portions of the formation.

23. The method of claim 1, wherein the microwave radiation is transmitted only during selected, discrete time periods.

24. The method of claim 1, wherein differing sets of first emitters are energized at differing times.

25. The method of claim 1, wherein the acoustic energy comprises multiple acoustic energy frequencies to form complex and/or modulated vibrational waves.

26. The method of claim 8, wherein the surfactant is injected at an acoustic slow wave point at which point the motion of the solid and pore liquid is approximately 180 degrees out of phase.

* * * * *